United States Patent [19]

Ojima et al.

[11] Patent Number: 4,999,268

[45] Date of Patent: Mar. 12, 1991

[54] FUNCTION SEPARATED ELECTROPHOTOGRAPHIC PHOTORECEPTOR CONTAINING SELENIUM

[75] Inventors: Fumio Ojima; Kiyokazu Mashimo; Masahiko Hozumi; Taketoshi Hoshizaki; Kazuyuki Nakamura, all of Kanagawa, Japan

[73] Assignee: Fuji Xerox Co., Ltd., Tokyo, Japan

[21] Appl. No.: 307,562

[22] Filed: Feb. 6, 1989

[30] Foreign Application Priority Data

Feb. 10, 1988 [JP] Japan ..... 63-27421

[51] Int. Cl.[5] ..... G03G 5/14

[52] U.S. Cl. ..... 430/59

[58] Field of Search ..... 430/59, 58

[56] References Cited

U.S. PATENT DOCUMENTS 4,808,506 2/1989 Loufty ..... 430/59

FOREIGN PATENT DOCUMENTS 52-120834 10/1977 Japan .
53-27033 3/1978 Japan .
57-144557 9/1982 Japan .

*Primary Examiner*—J. David Welsh
*Attorney, Agent, or Firm*—Finnegan, Henderson, Farabow, Garrett, and Dunner

[57] ABSTRACT

An electrophotographic photoreceptor is disclosed, comprising a light-sensitive layer on an electrically conductive substrate, wherein the light-sensitive layer comprises particles of selenium or a selenium alloy as the charge generating material, and at least one compound represented by formula (I), wherein $R_1$ represents a hydrogen atom, an alkyl group or an alkoxyl group; $R_2$ and $R_3$, which may be the same or different, represent each a hydrogen atom, an alkyl group, an alkoxyl group, a halogen atom, an alkoxycarbonyl group or a substituted amino group; and at least one compound represented by formula (II), (II)

wherein $R_4$, $R_5$ and $R_6$, which may be the same or different, represent each a hydrogen atom, an alkyl group, an alkoxy group, a halogen atom, an alkoxycarbonyl group or a substituted amino group, as the charge transporting materials. Preferably, the selenium or selenium alloy particles are dispersed in a charge generating layer formed on the substrate, and a charge transporting layer containing the compounds of formula (I) and formula (II) is formed on the charge generating layer.

12 Claims, 1 Drawing Sheet

FUNCTION SEPARATED ELECTROPHOTOGRAPHIC PHOTORECEPTOR CONTAINING SELENIUM

FIELD OF THE INVENTION

The present invention is directed to a photoreceptor for use in electrophotography to form a latent electrostatic image.

BACKGROUND OF THE INVENTION

Conventional photoreceptors used in electrophotography may be grouped into two types of photoreceptors depending on whether inorganic or organic photoconductive material is used in the photoconductive layer. Organic photoconductive materials are widely used since they offer certain advantages such as high production rate and low manufacturing costs.

Recently, a so-called "function separated" type photoreceptor, in which the various functions and capabilities of the photoreceptor are divided and distributed among and between plural component layers of the photoreceptor system, has gained popularity. A variety of various systems have been proposed with a view towards improving the quality and characteristics of such photoreceptors including charge retention, stability to cyclic operation, sensitivity, spectral characteristics and mechanical strength.

A function separated organic photoreceptor comprises a charge generating layer and a charge transporting layer formed on an electrically conductive substrate. It is known that organic pigments such as bis-azo pigments and condensed polycyclic quinone pigments are suitable for use as charge generating materials in the charge generating layer. Organic pigments, however, generally have a low charge generating efficiency, and photoreceptors which utilize the above organic pigments in the charge generating layer are not completely satisfactory in terms of sensitivity.

In attempting to resolve these problems, several proposals have been made to replace the organic pigments with inorganic photoconductive materials such as selenium or selenium alloys as in, for example, JP-A-52-120834 and JP-A-53-27033 (The term "JP-A" as used herein means an "unexamined, published Japanese patent application"). Although these approaches are effective in achieving acceptable levels of photoreceptor sensitivity, there remains a need to improve the stability of cyclic operations.

Suitable charge transporting materials for use in the charge transporting layer include, for example, amine compounds, pyrazoline compounds, oxadiazole compounds, carbazole compounds and hydrazone compounds. However, it has not been possible to use these charge transporting materials in conjunction with the above-described charge generating materials to produce a function separated, layered photoreceptor which ensures satisfactory performance in practical electrophotographic applications.

There are two basic prerequisites to attaining satisfactory electrophotographic performance with conventional function separated, layered photoreceptors having a charge generating layer and a charge transporting layer. The first requirement is efficient charge generation in response to light absorption due to the charge generating materials. The second requirement is efficient injection and transport of the generated charge across the charge transporting material. If only the first requirement is satisfied, the photoreceptor cannot respond to light in a satisfactory manner.

In some instances, the photoreceptor has the charge transporting layer positioned on top of the charge generating layer with light exposure originating from the charge transporting layer side. In such a photoreceptor, it is important that the charge transporting layer be adequately transparent in order to produce a photoreceptor having a high level of sensitivity, i.e., light must pass through the charge transporting layer and reach the charge generating layer without substantial reflection and/or absorption by the charge transporting layer.

Although a variety of various charge generating and charge transporting materials have been used in fabricating electrophotographic photoreceptors, it nevertheless remains an extremely difficult proportion to select combinations of charge generating and charge transporting materials that satisfy not only the two basic prerequisites as mentioned above but also all other relevant criteria including electrophotographic characteristics, such as sensitivity, acceptance potential, charge retention, potential stability, residual potential and spectral characteristics; operating characteristics, such as strength, durability and smudge resistance; as well as consistency in the production and quality of applied coatings.

Currently, there are several known charge generating materials which satisfy the first prerequisite of efficient charge generating in response to light absorption. One of these is a bis-azo pigment such as chlorodian blue, described in JP-A-57-144557 which is known to exhibit a relatively high charge generation efficiency. Such pigments, however, do not exhibit sufficient photoresponse and therefore are not suitable for use in high-speed copying machines.

As previously discussed, efficient charge generation by the charge generating layer is one of two prerequisites for satisfactory electrophotographic performance. That is, satisfactory electrophotographic performance cannot be achieved without also having charge transporting materials that can efficiently inject and transport the generated charges across the charge transporting layer. It is known that, in some cases, the injection of generated charges into the charge transporting layer bears a relationship and is therefore affected by the difference in ionization potential between the charge generating material and charge transporting material. This applies, however, only to a limited number of materials, and no clear relationship has yet been established which correlates this relationship with electrophotographic characteristics and performance. It can, however, be said that the efficiency of charge injection is largely dependent upon the characteristics of the charge generating and charge transporting materials used in combination. There are a variety of factors which change from one type of material to the other and which, therefore, have varying effects on charge injection depending on the particular charge generating and charge transporting materials used in making the photoreceptor.

SUMMARY OF THE INVENTION

The present invention overcome the problems and disadvantages of the prior art by providing a novel electrophotographic photoreceptor comprising a combination of materials that satisfies all of the prerequisites for a photoreceptor. The present electrophotographic photoreceptor represents a significant improvement and a completely novel approach for satisfying the needs and requirements of electrophotography in a cost effective manner.

Accordingly, it is an object of the present invention to provide an improved electrophotographic photoreceptor that uses a novel combination of charge generating and charge transporting materials and which satisfies all of the requirements for a satisfactory photoreceptor.

It is another object of the present invention to provide an electrophotographic photoreceptor having improved electrophotographic characteristics in terms of photosensitivity, potential stability to cyclic operation and residual potential suitable for use in various electrophotographic processes.

It is a further object of the present invention to provide an electrophotographic photoreceptor that has a high level of sensitivity to light and a high degree of flexibility in application and which can be easily and cost effectively manufactured.

Additional objects and advantages of the present invention will be set forth, in part, in the description which follows, and, in part, will be obvious from the description or may be learned by and attained by means of the instrumentalities and combination particularly pointed out in the appended claims.

To achieve the foregoing objects and in accordance with the purpose of the present invention, as embodied and broadly described herein, the electrophotogarphic photoreceptor of the present invention comprises a light-sensitive layer on an electrically conductive substrate, the light-sensitive layer comprising (1) particles of selenium or selenium-based alloys as the charge generating material; and (2) at least one compound represented by formula (I), (I)

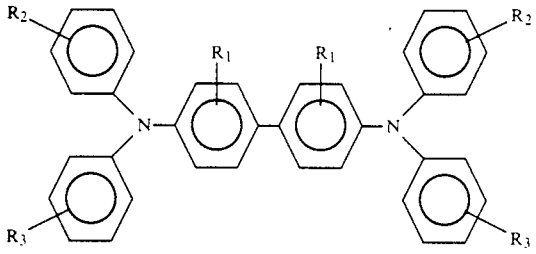

wherein $R_1$ represents a hydrogen atom, an alkyl group or an alkoxyl group; $R_2$ and $R_3$, which may be the same or different, represent each a hydrogen atom, a halogen atom, an alkyl group, an alkoxyl group, an alkoxycarbonyl group or a substituted amino group, and at least one compound represented by formula (II), (II)

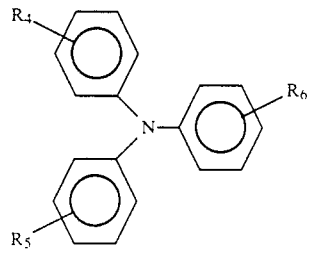

wherein $R_4$, $R_5$ and $R_6$, which may be the same or different, represent each a halogen atom, an alkyl group, an alkoxyl group, an alkoxycarbonyl group or a substituted amino group, as the charge transporting materials. With respect to both compounds of formula (I) and (II): the alkyl group as described above preferably has from 1 to 5 carbon atoms; the alkoxyl group as described above preferably has from 1 to 5 carbon atoms; and the alkoxycarbonyl group as described above preferably has from 2 to 6 carbon atoms.

DETAILED DESCRIPTION OF THE INVENTION

Figure 1:
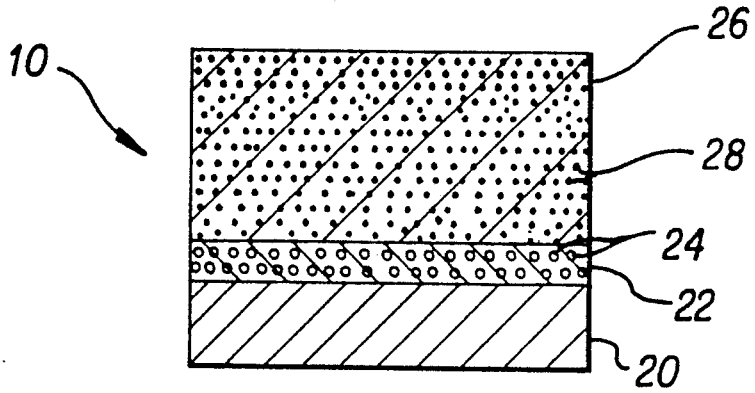
FIG. 1 is a cross-sectional, schematic view of an embodiment of the electrophotographic photoreceptor of the present invention.

Reference will now be made, in detail, to preferred embodiments of the present invention, examples of which are illustrated in the accompanying drawings and which is represented generally by the numeral 10. Whenever possible, the same reference numbers will be used throughout the drawings to refer to the same or like parts.

The charge generating material used in the charge generating layer of the present invention comprises selenium or selenium alloy particles as the primary component with a preferred volume percent in the range of generally from 30 to 80 vol %, and, more preferably, from 50 to 70 vol %. If the content of selenium or selenium alloy particles is less than 30 vol %, the sensitivity of the photoreceptor decreases to an unsatisfactory level. On the other hand, if the content of selenium or selenium alloy particles exceeds 80 vol %, not only does the charge acceptance of the charge generating layer become diminished to unsatisfactory levels, but the adhesion and physical integrity of the charge generating layer is also greatly impaired.

Specific examples of selenium and selenium alloy particles suitable for use in the present invention include amorphous selenium, trigonal selenium, seleniumtellurium alloy, selenium tellurium-arsenic alloy, and mixtures thereof. In terms of sensitivity and spectral characteristics, trigonal selenium is preferred as a better charging generator than amorphous selenium. In the context of the present invention, however, undoped, elemental trigonal selenium is particularly preferred.

Specific examples of compounds represented by the formula (I) include the following compounds.

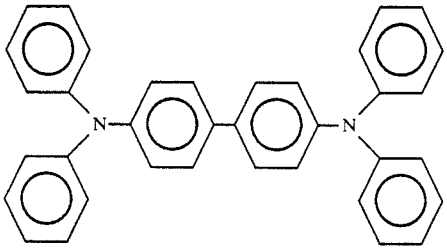
I-1
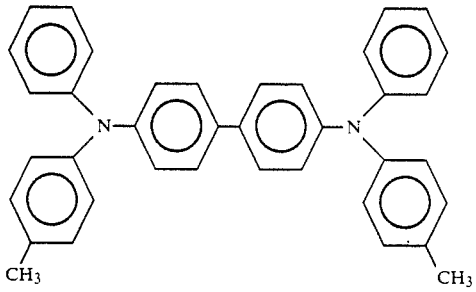
I-2
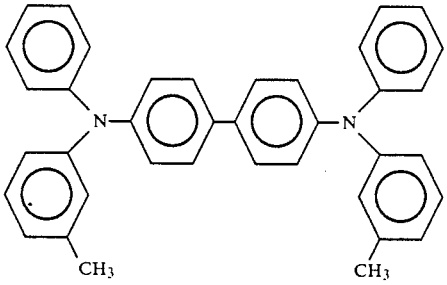
I-3
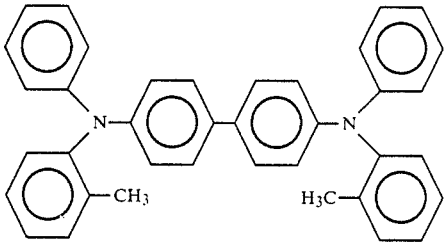
I-4
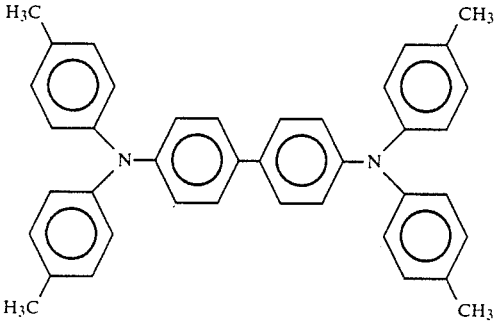
I-5
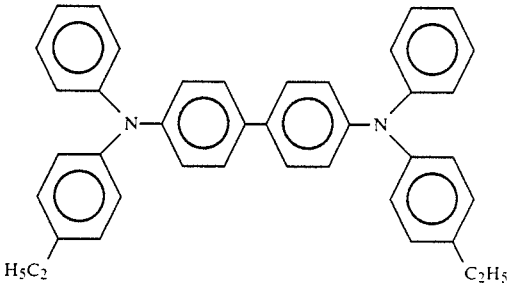
I-6
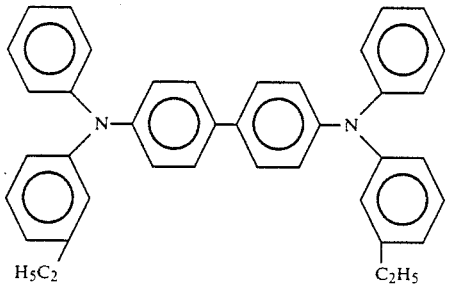
I-7
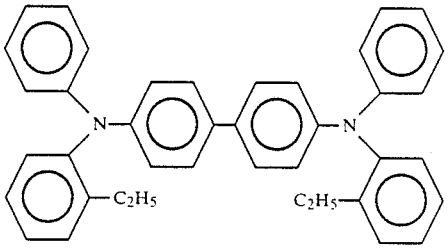
I-8

-continued
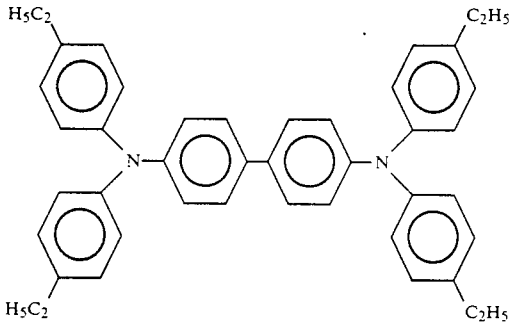
I-9
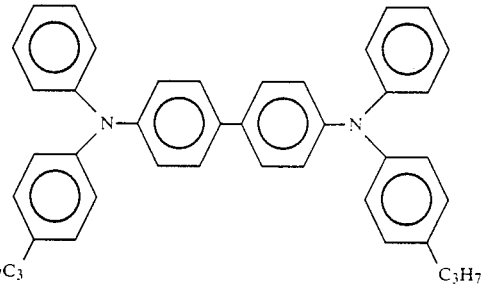
I-10
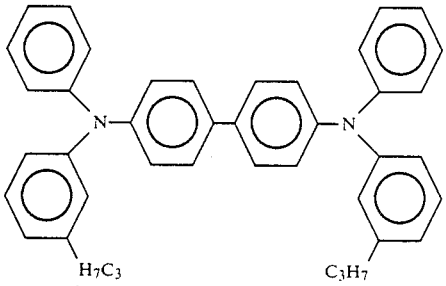
I-11
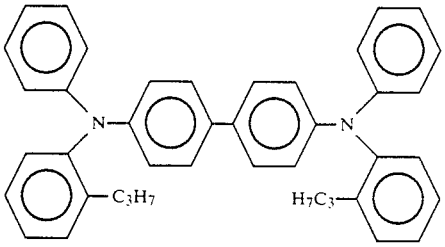
I-12
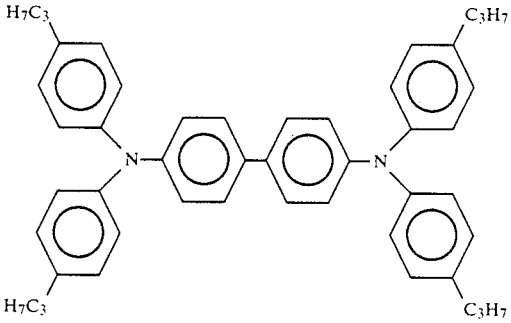
I-13
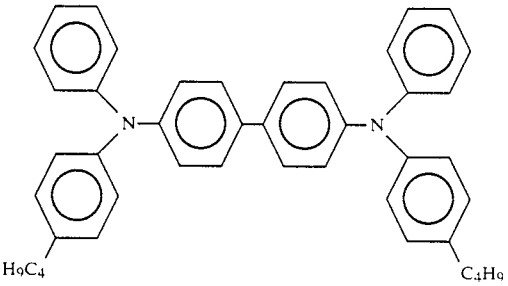
I-14
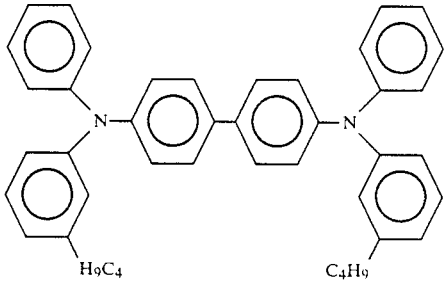
I-15
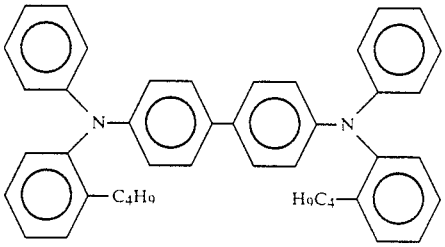
I-16

-continued
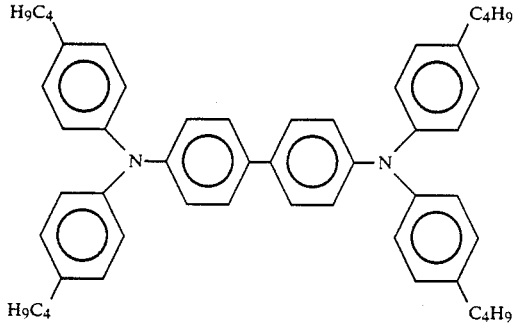
I-17
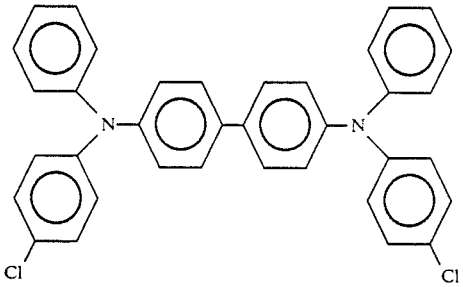
I-18
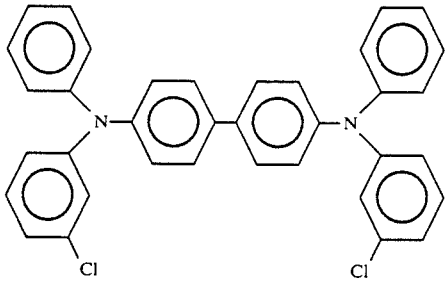
I-19
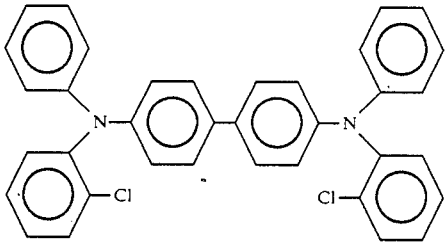
I-20
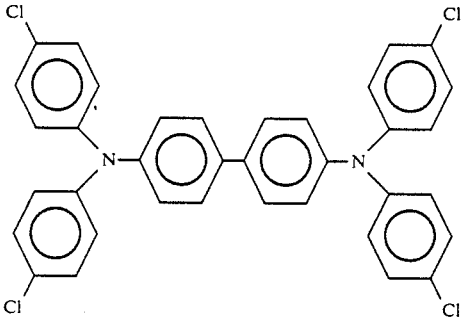
I-21
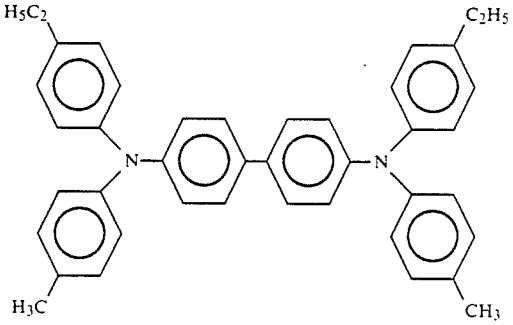
I-22
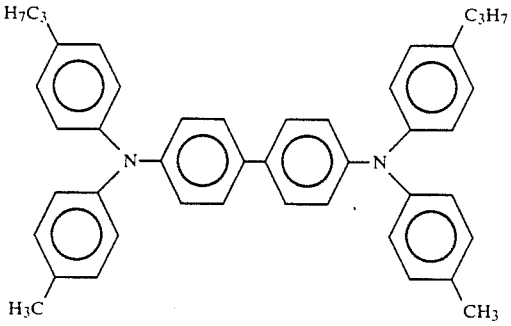
I-23
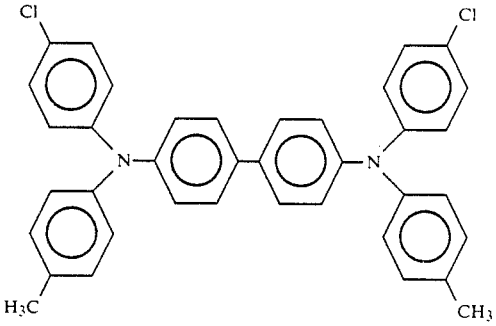
I-24

-continued
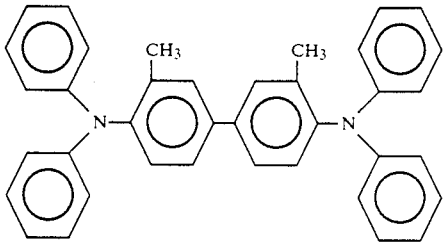
I-25
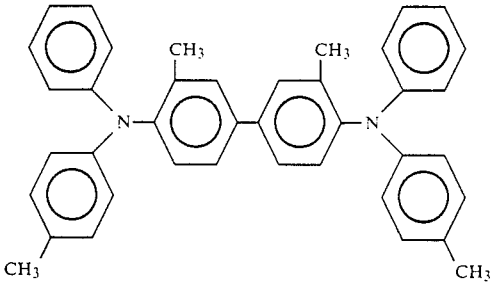
I-26
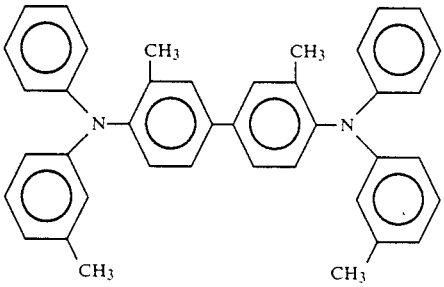
I-27
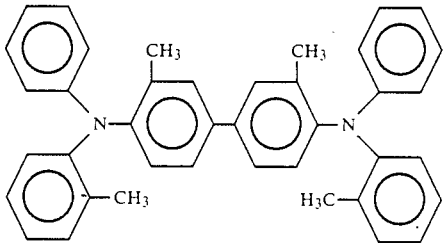
I-28
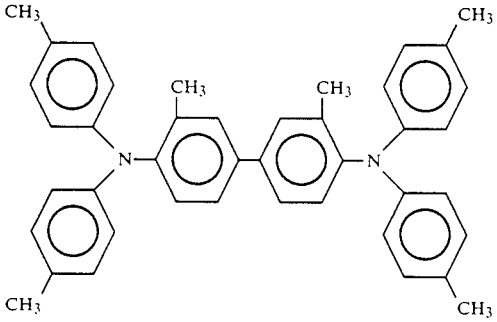
I-29
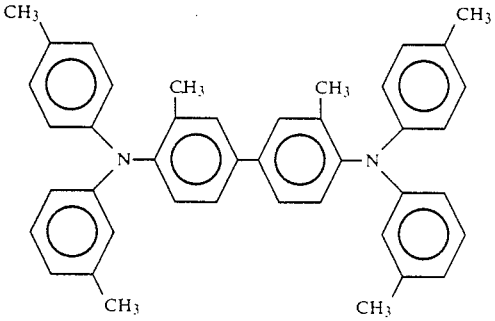
I-30
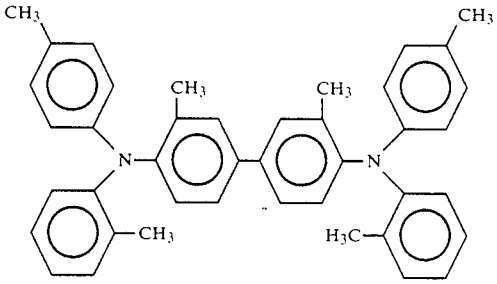
I-31
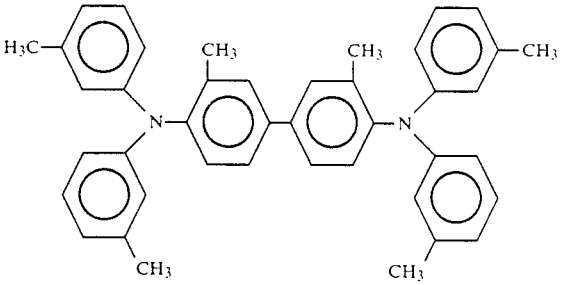
I-32

-continued
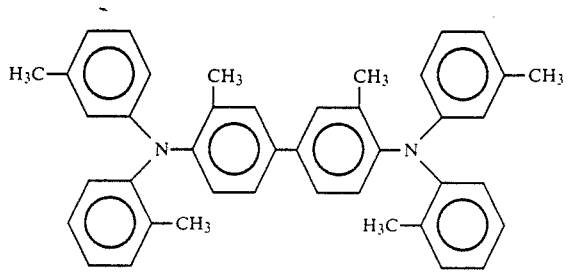
I-33
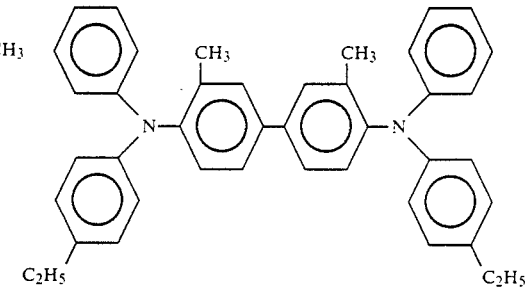
I-34
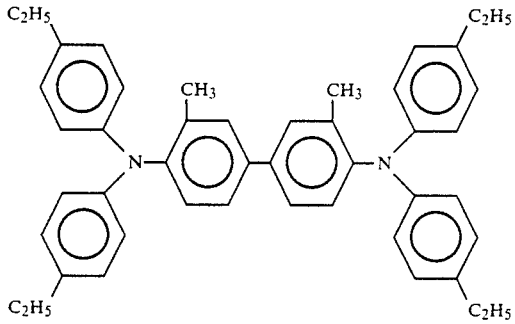
I-35
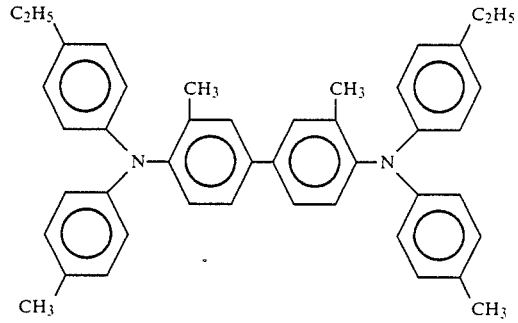
I-36
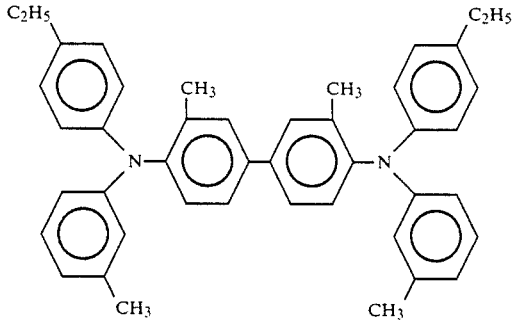
I-37
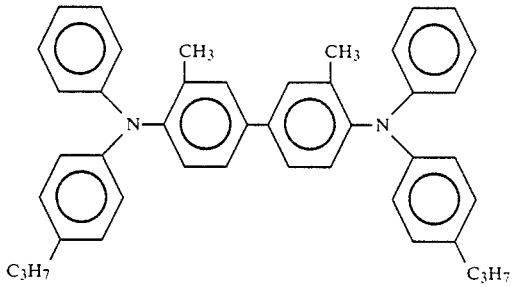
I-38
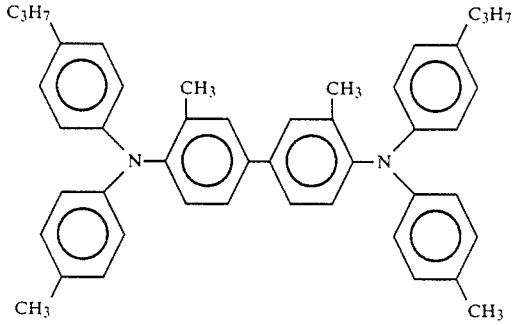
I-39
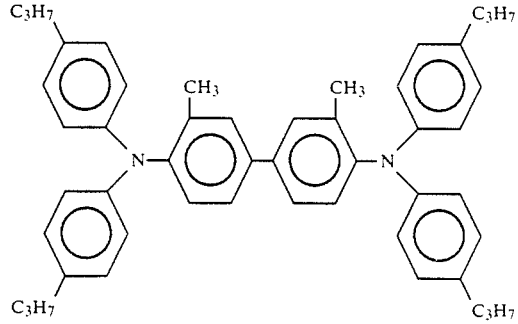
I-40

-continued
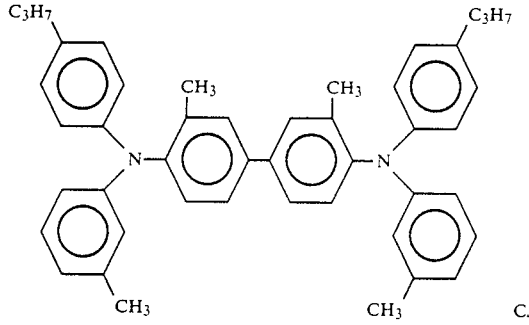
I-41
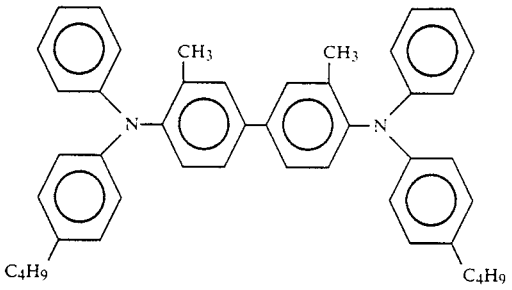
I-42
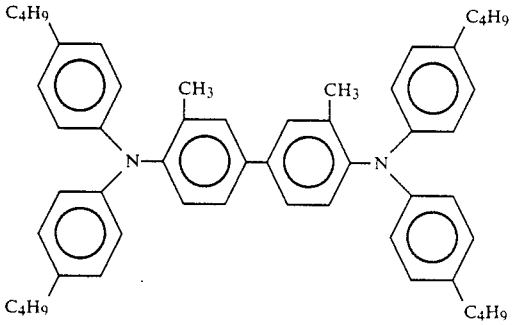
I-43
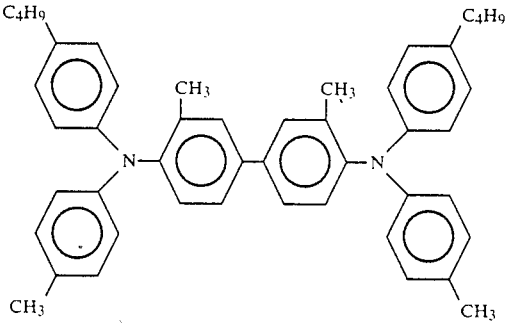
I-44
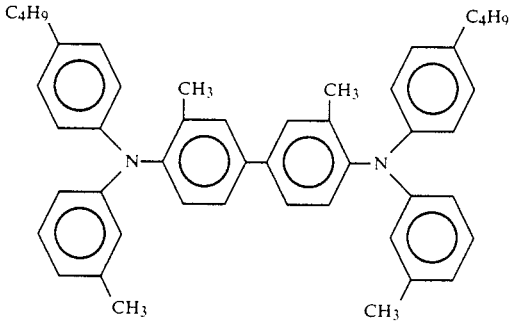
I-45
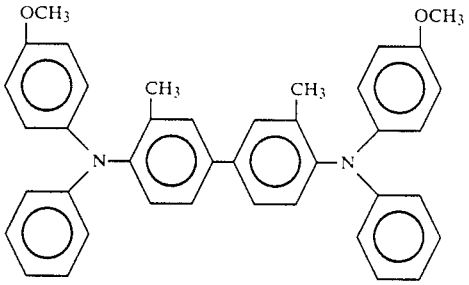
I-46
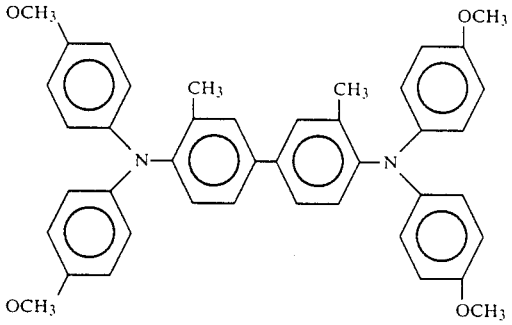
I-47
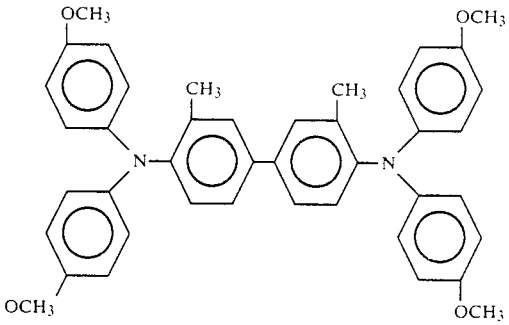
I-48

-continued
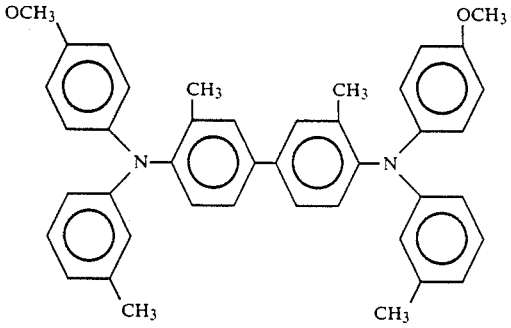
I-49
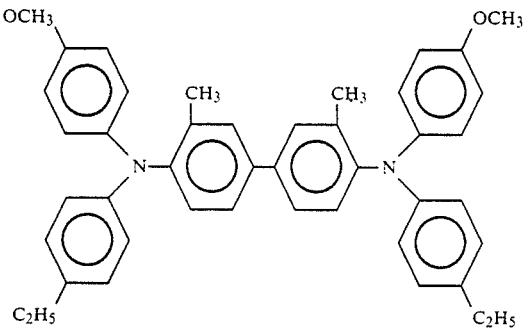
I-50
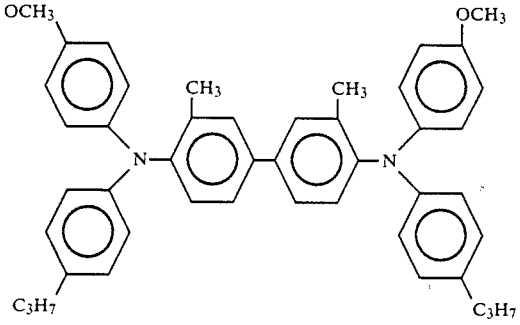
I-51
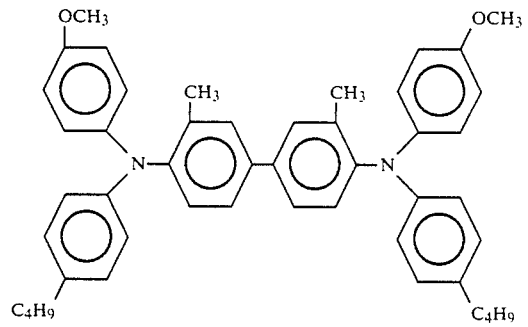
I-52
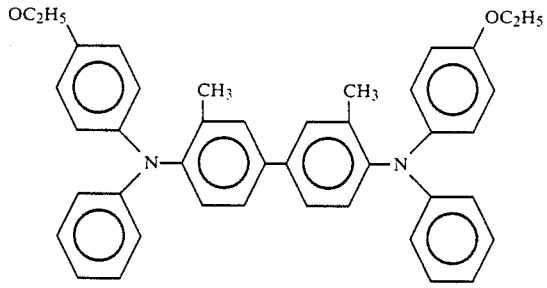
I-53
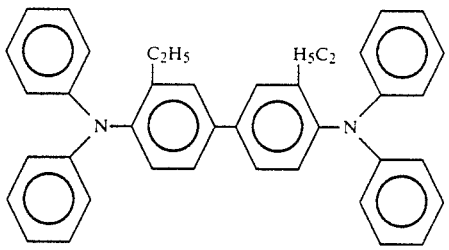
I-54
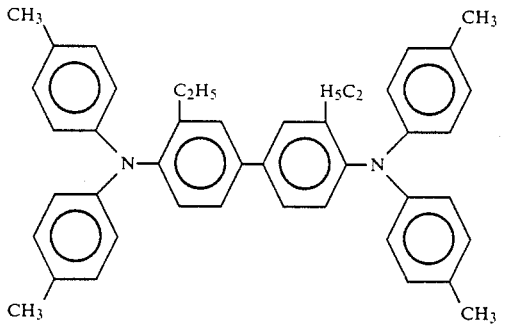
I-55
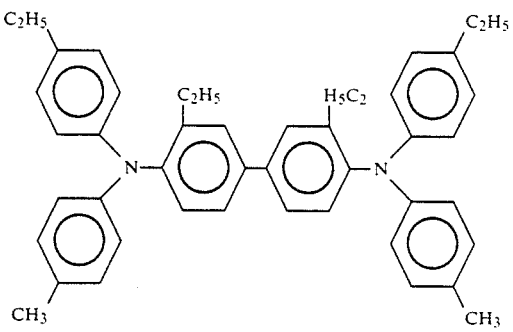
I-56

-continued
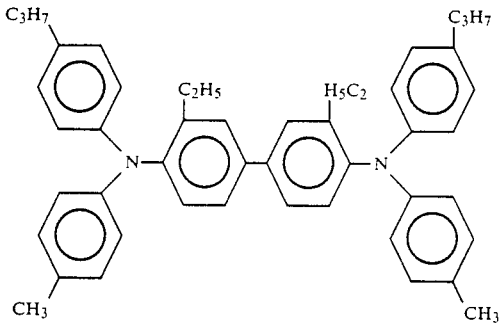
I-57
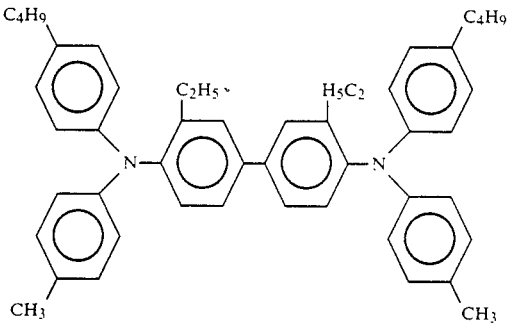
I-58
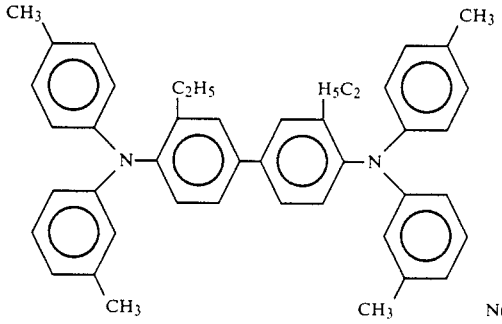
I-59
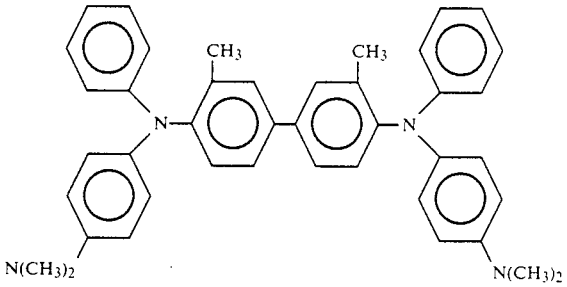
I-60
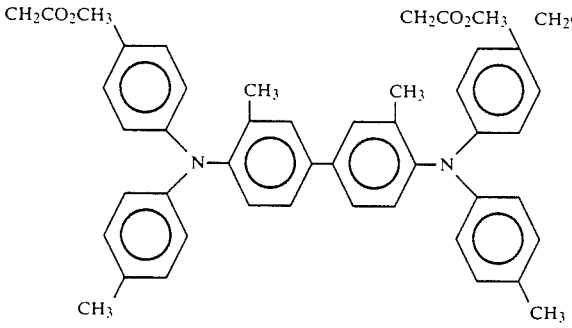
I-61
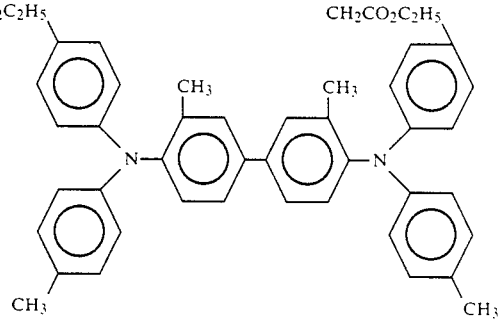
I-62
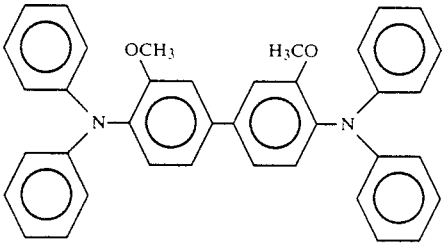
I-63
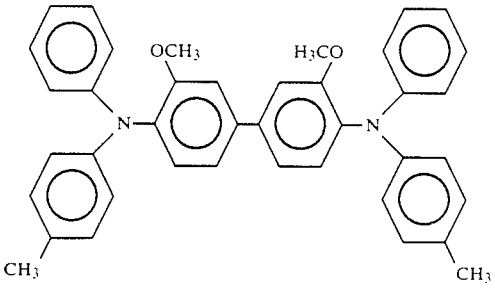
I-64

-continued
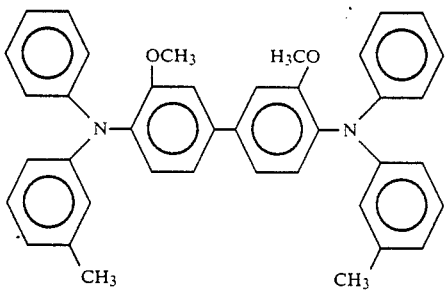
I-65
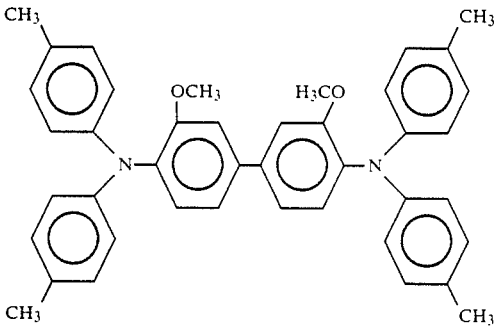
I-66
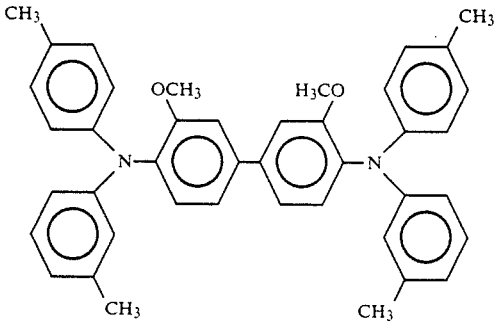
I-67
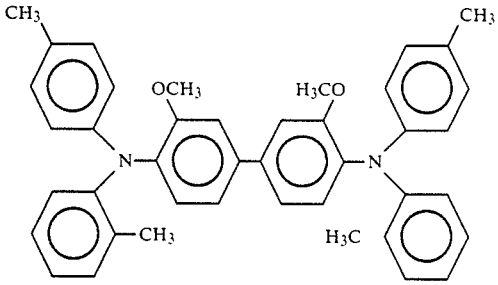
I-68
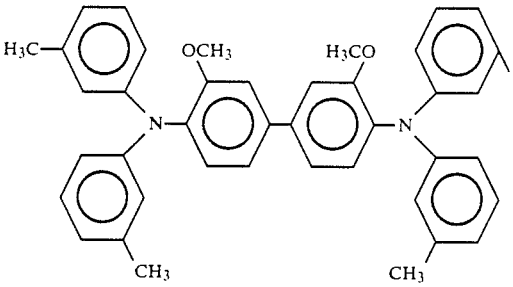
I-69
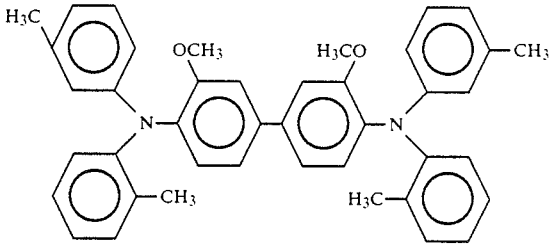
I-70
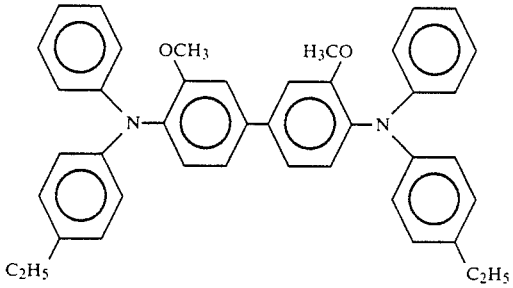
I-71
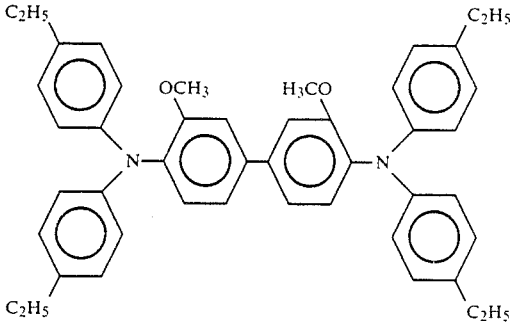
I-72

-continued
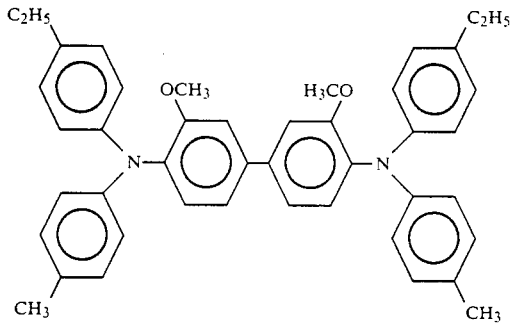
I-73
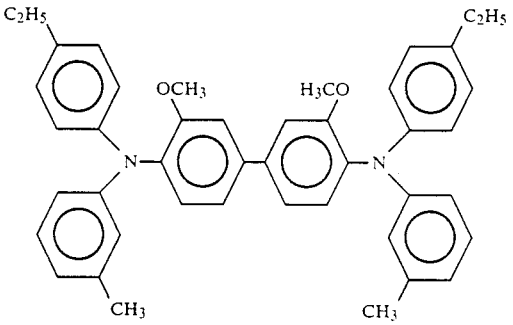
I-74
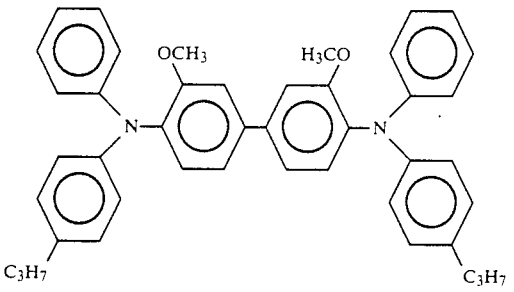
I-75
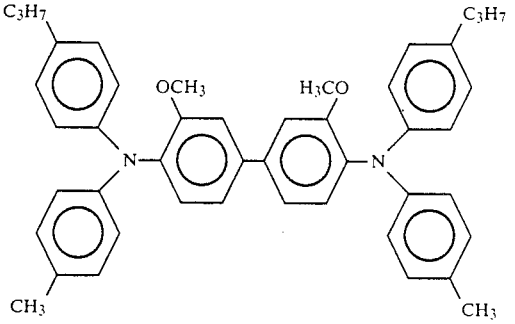
I-76
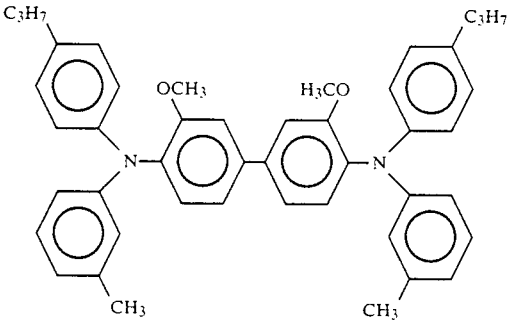
I-77
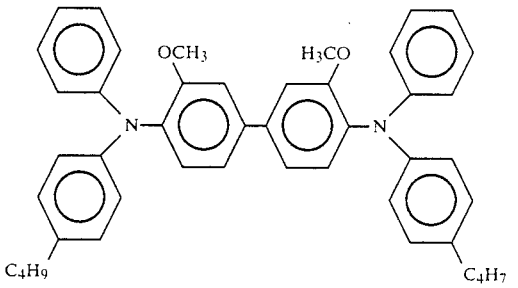
I-78
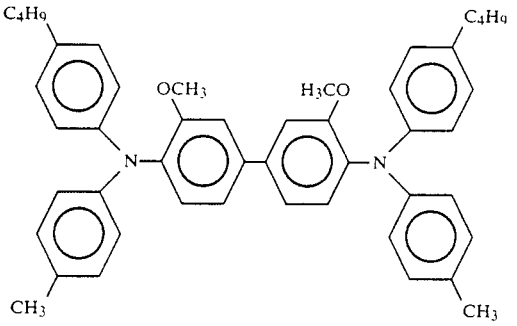
I-79
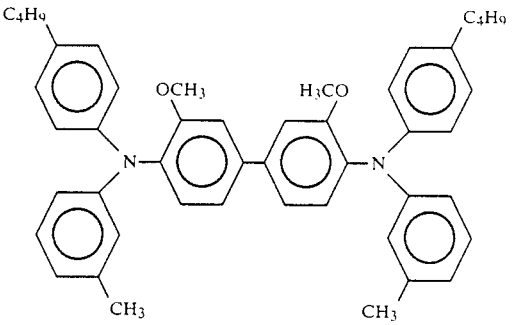
I-80

-continued
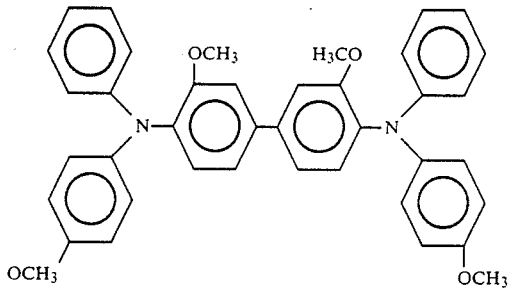
I-81
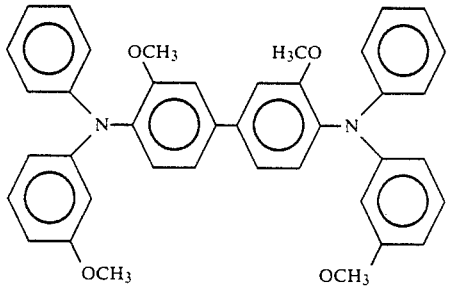
I-82
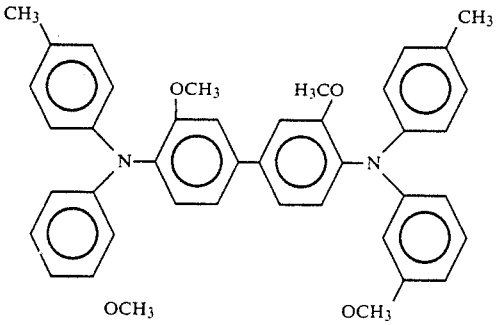
I-83
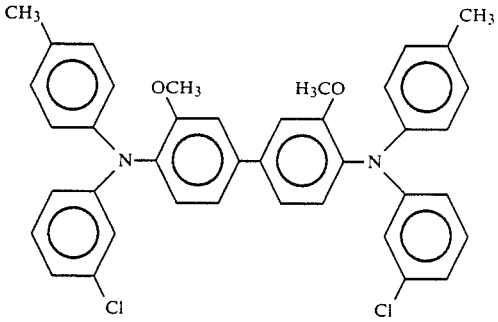
I-84
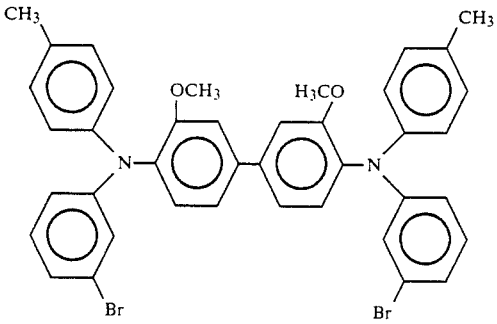
I-85
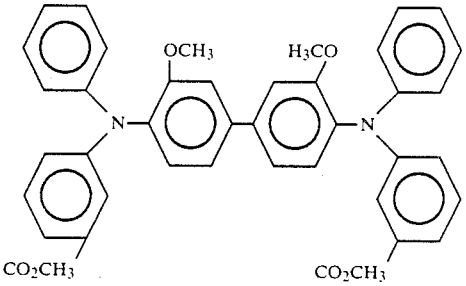
I-86
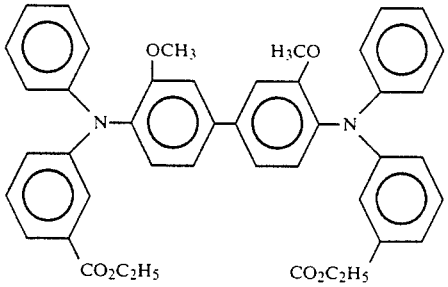
I-87
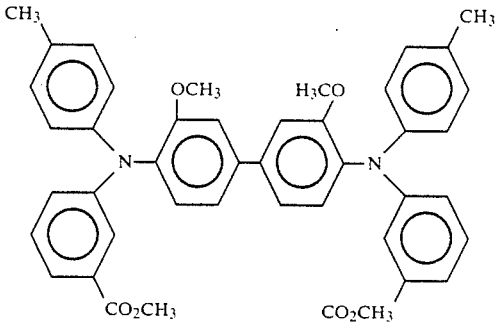
I-88

-continued
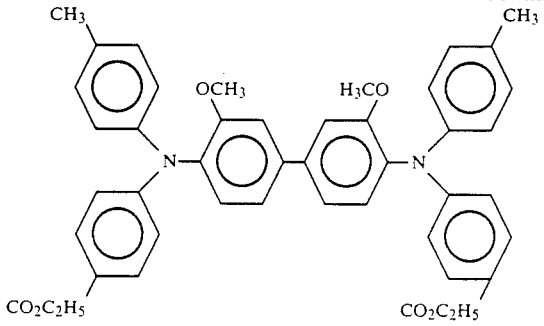
I-89
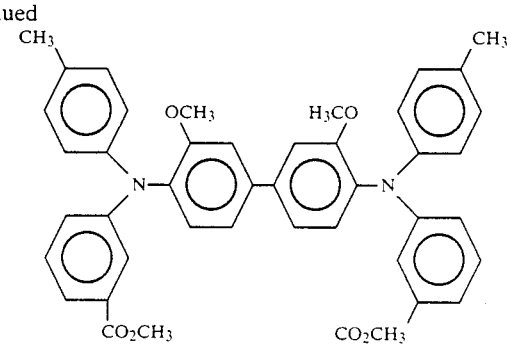
I-90
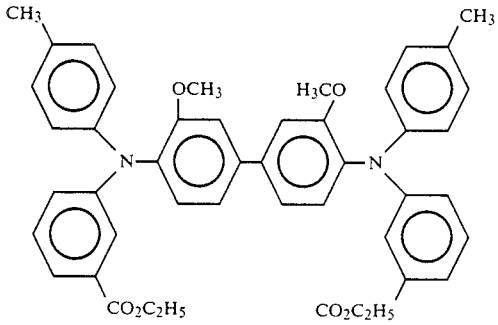
I-91
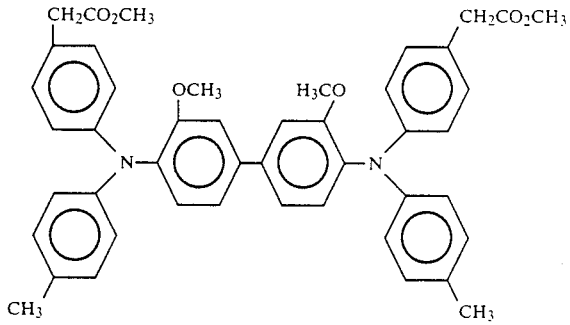
I-92
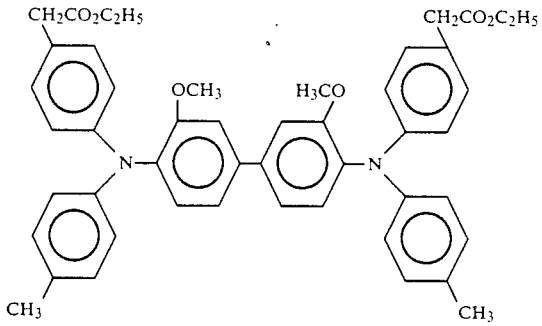
I-93
Specific examples of compounds represented by the formula (II) include the following compounds.
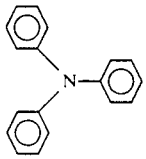
II-1
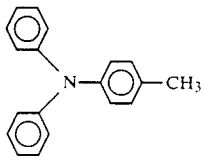
II-2
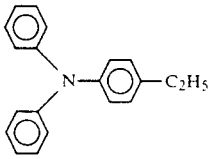
II-3
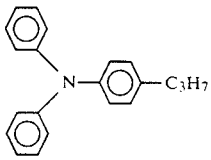
II-4
-continued
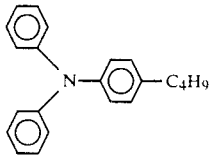
II-5
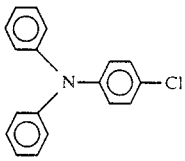
II-6
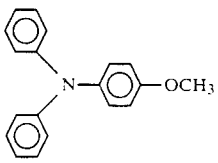
II-7
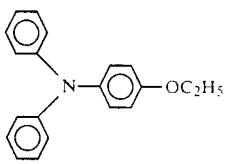
II-8

-continued
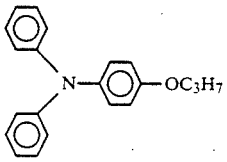
II-9
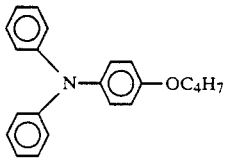
II-10
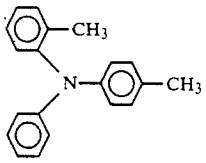
II-11
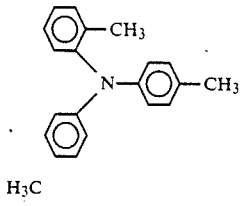
II-12
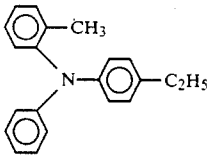
II-13
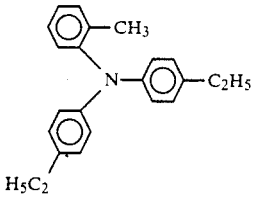
II-14
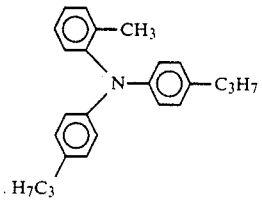
II-15
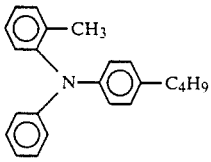
II-16
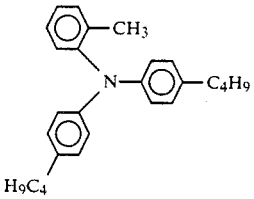
II-17
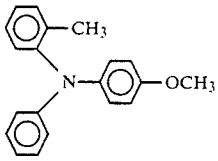
II-18
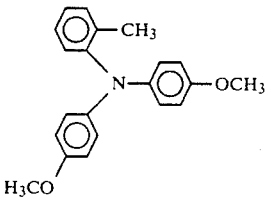
II-19
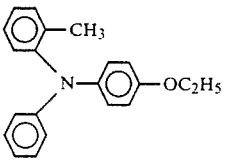
II-20
-continued
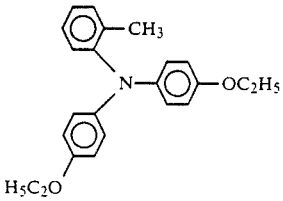
II-21
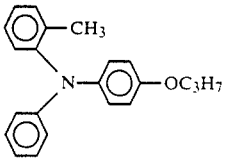
II-22
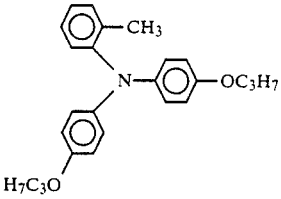
II-23
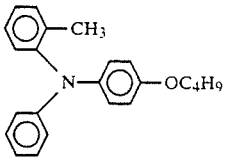
II-24
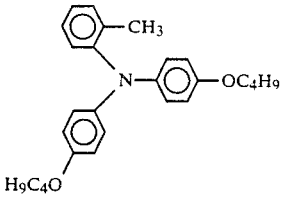
II-25
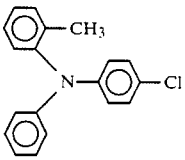
II-26
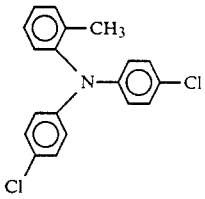
II-27
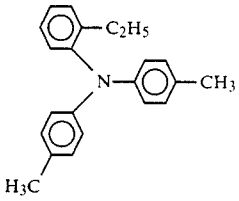
II-28
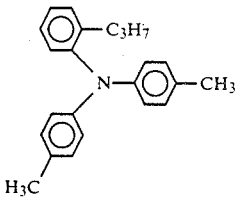
II-29
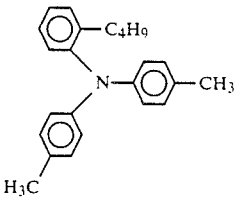
II-30
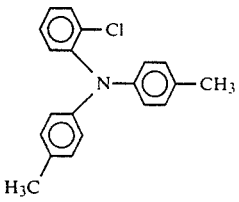
II-31
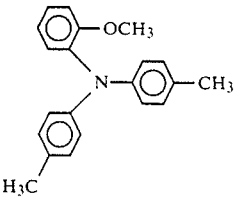
II-32

-continued

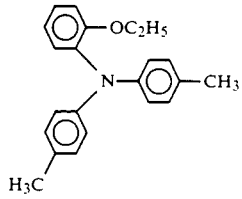

II-33

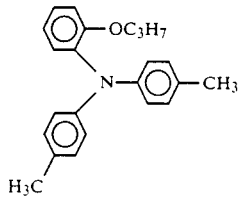

II-34

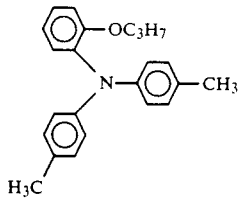

II-35

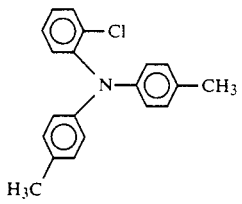

II-36

Of the above-specified compounds represented by formula (I), compounds I-3, I-29, I-36 and I-56 are preferred for use in the present invention. Of the above specified compounds represented by formula (II), compound II-19 is preferred for use in the present invention.

Figure 2:
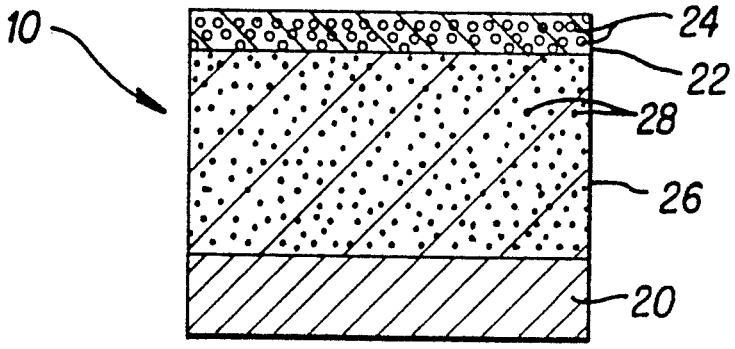
FIG. 2 is another cross-sectional, schematic view of another embodiment of the electrophotographic photoreceptor of the present invention.

As previously set forth, in the present invention, the particles of selenium or selenium alloy and the compounds of formulas (I) and (II) are incorporated in a light-sensitive layer formed on an electrically conductive substrate. In a preferred embodiment of the present invention the photoreceptor comprises a function separated, plural layered system having a charge generating layer and a charge transporting layer as shown in FIGS. 1 and 2. The photoreceptor 10 shown in FIG. 1 comprises an electrically conductive substrate 20 having formed thereon a charge generating layer 22 containing charge generating material 24. A charge transporting layer 26, containing charge transporting materials 28, is on top of the charge generating layer 22. The photoreceptor 10 shown in FIG. 1 is suitable for use in conjunction with a negative charging electrophotographic system. The photoreceptor 10 shown in FIG. 2 comprises an electrically conductive substrate 20 having formed thereon a charge transporting layer 26 containing charge transporting materials 28. A charge generating layer 22 containing charge generating materials 24 is on top of the charge transporting layer 26. The photoreceptor 10 shown in FIG. 2 is suitable for use in conjunction with a positive charging electrophotographic system.

There are a variety of various materials which are suitable for use as electrically conductive substrates in the present invention. Specific examples of suitable electrically conductive substrates include plates, drums or foils made of metals such as aluminum, nickel and chromium; alloys such as stainless steel; plastic films or sheets which are coated with thin films of aluminum, titanium, nickel, chromium, SUS (stainless steel), gold, vanadium, tin oxide, indium oxide, indium-tin oxide (ITO); and paper or plastic films coated or impregnated with an agent which imparts conductivity.

The charge generating layer is formed by coating a dispersion of selenium or selenium alloy particles in a solution of a binder resin. Any suitable solvent material may be used as a solvent of the binder resin so long as it dissolves the binder resin. Dispersions may be prepared by conventional means such as a ball mill, roll mill, sand mill, attriter, etc. It is desirable to select solvents that are also capable of forming uniform pigment dispersions. If desired, two or more solvents may be used together.

Binder resins which are suitable for use in the present invention include various resins such as, for example, polycarbonates, polystyrene, polyesters, polyvinyl butyral, methacrylic acid ester homo- or copolymers, vinyl acetate homo or copolymers; cellulose esters or ethers, polybutadiene, polyurethanes, epoxy resins; and vinylchloride-vinylacetate copolymers. The resin binders may be used either alone or as admixtures with other resin binders Of the above specified resins, polyesters, polyvinyl butyral and vinylchloride-vinylacetate copolymers are preferred for use in the present invention.

The particles size of the selenium or selenium alloy particles used in the present invention is preferably 1 micron or smaller in diameter and, more preferably, is from 0.03 to 0.5 micron in diameter. If the particle size of the selenium or selenium alloy particles is excessively large, problems such as unstable coating solutions and impaired image quality occur.

The thickness of the charge generating layer is desirably in a range of from about 0.01 to about 5 microns and, preferably, from about 0.03 to about 2 microns. If the charge generating layer is more than about 5 microns, problems such as reduced chargeability, increased dark decay and reduced stability in cyclic operation occur. If the thickness of the charge generating layer is less than about 0.01 micron, problems such as reduced sensitivity occur.

The charge transporting layer of the present invention is formed by dispersing in a film-forming resin at least one compound of the formula (I) and at least one compound of the formula (II). The compounds may be mixed in a wide range of proportions; however, it is preferred that the compounds be mixed in about equal proportions.

With respect to the proportion ratio between the compounds and the film-forming resin, the ratio is preferably a range of generally from 5/1 to 1/5, and more preferably, from 3/1 to 1/3. If the proportion of the compounds is more than 5/1, the resulting charge transporting layer fails to exhibit high mechanical strength and, thus, has a tendency to lose its physical integrity. If the proportion of the film-forming resin is less than 1/5, sensitivity decreases. Accordingly, suitable proportion ratios between the compounds and the resin is desirably within the ranges as set forth above.

The film-forming resin is used to form a film which comprises the formula (I) and formula (II) compounds since the compounds themselves lack the ability to form the desired film. Any resin may be employed which is suitably miscible with the formula (I) and formula (II) compounds and which have suitable film-forming ability. Preferably, the film-forming resin should be highly miscible with the compounds. Examples of suitable film-forming resins include polycarbonates such as bisphenol A-type, bisphenol Z-type or modified polycarbonates; polyacrylates; polyesters; polystyrenes; styrene-acrylonitrile copolymers; polysulfones; polymethacrylic acid esters; styrene-methacrylic acid ester copolymers; and vinyl polymers. Of the above specified film-forming resins, bisphenol A-type polycarbonates, bisphenol Z-type polycarbonates and modified polycarbonates are preferred for use in the present invention.

The charge transporting layer is formed by coating a solution of the compounds of formula (I) and formula (II) and the film-forming resin in a solvent. The solvent to be used varies with the film-forming resin used, but any suitable solvent may be used so long as the solvent is capable of dissolving both formula (I) and formula (II) compounds and the film-forming resin.

The thickness of the charge transporting layer is desirably in a range of from about 5 to about 50 microns and, preferably, from about 7 to about 30 microns.

The use of a charge blocking layer in the photoreceptor of the present invention is desirable. A charge blocking layer is preferably provided between the light-sensitive layer and the electrically conductive substrate of the photoreceptor. The charge blocking layer is effective in blocking out the injection of unwanted charges from the substrate and serves to enhance the chargeability of the light-sensitive layer and improve image quality. It is also effective in providing increased adhesion between the light-sensitive layer and the conductive substrate. Examples of constituent materials for the charge blocking layer include polyvinyl alcohol, polyvinyl pyrrolidone, polyvinyl pyridine, cellulose ethers, cellulose esters polyamides, polyurethane, casein, gelatin, polyglutamic acid, starch, starch acetate, amino starch, polyacrylic acid salts, polyacrylic amides, silane coupling agents, zirconium chelate compounds, and titanium chelate compounds. Constituent materials for the charge blocking layer preferably have an electrical resistance of from about $10^5$ and about $10^{14}$ ohm.cm and, more preferably, from about $10^7$ and about $10^{12}$ ohm.cm. The thickness of the charge blocking layer is desirably in a range of from about 0.01 and about 2 microns and, preferably, from about 0.05 end about 1 micron.

A surface protective layer may be provided on the light-sensitive layer as desired. The surface protective layer serves not only to prevent chemical deterioration of the light-sensitive layer during charging but also serves to improve the mechanical strength and physical integrity of the light-sensitive layer.

The surface protective layer comprises an electrically conductive material dispersed in a suitable binder resin. Specific examples of suitable electrically conductive materials include metallocene compounds such as N,N'-dimethyl ferrocene; aromatic amino compounds such as N,N'-diphenyl-N,N'-bis-(3-methylphenyl)-(1,1'-biphenyl)-4,4'-diamine; and metal oxides such as antimony oxide, tin oxide, titanium oxide, indium oxide, and tin oxide-antimony oxide. Specific examples of suitable binder resins for the surface protective layer include polyamide resins, polyurethane, polyester resins, epoxy resins, polyketone resins, polycarbonates, polyvinyl ketone resins, polystyrene and polyacrylamide resins.

The electrical resistance of the surface protective layer is suitably adjusted to be between about $10^9$ and $10^{14}$ ohm.cm. If the electrical resistance exceeds about $10^{14}$ ohm.cm, residual potential increases to produce a fogged reproduction copy. If the electrical resistance is below about $10^9$ ohm.cm, blurring of the image occurs and results in an image having reduced resolution. The surface protective layer should not substantially block the passage of light to the charge generating layer.

The surface protective layer, if used in the photoreceptor of the present invention, should have a thickness of from 0.5 and 20 microns and, more preferably, from 1 to 10 microns.

The various layers of the photoreceptor of the present invention may be formed by any common method such as, for example, blade coating, wire bar coating, spray coating, dip coating, bead coating or curtain coating.

The following examples are provided merely to further illustrate and explain the present invention, and it is intended that the scope of the present invention not be limited to the specific examples thus provided.

EXAMPLE 1

A mixture consisting of 70 parts by weight of trigonal selenium (made by Xerox Corporation, U.S.A.) 30 parts by weight of a polyvinyl butyral resin ("BX-1" made by Sekisui Chemical Co., Ltd.) and 300 parts by weight of n-butanol was worked up in a ball mill for 24 hours with $\frac{1}{8}$" SUS (stainless steel) balls. One part by weight of the resulting dispersion was diluted with 2 parts by weight of n-butanol, and the mixture was stirred to form a coating solution for a charge generating layer. The prepared coating solution was applied to an aluminum substrate by dip coating to form a charge generating layer having a dry thickness of about 0.2 micron.

To prepare a coating solution of a charge transporting layer, four parts by weight each of compounds I-36 and II-19 were added to a solution having 12 parts by weight of a polycarbonate resin ("k-1300" made by Teijin Chemicals Ltd.) dissolved in 80 parts by weight of dichloromethane. The prepared coating solution was applied to the charge generating layer by dip coating to form a charge transporting layer having a dry thickness of 25 microns.

The resulting electrophotographic photoreceptor consisted of an aluminum substrate having a charge generating layer formed thereon and a charge transporting layer formed on top of the charge generating layer as shown in FIG. 1. The performance of the photoreceptor was evaluated by the following procedures using an apparatus for evaluating electrophotographic characteristics.

The photoreceptor was charged to produce a current input of $-10$ $\mu$A, and the surface potential was measured one second after the charging. This potential was designated $V_{PO}$ (in volts). Thereafter, the residual charge was erased from the photoreceptor by flooding with a tungsten lamp. The measured potential after erasure was designated as the residual potential $V_R$. This procedure was repeated 100 times to check the stability of the photoreceptor to cyclic operation.

Subsequently, the charging current was adjusted to produce $V_{PO}$ of $-800$ volts. After the charging, the photoreceptor was exposed to monochromatic light (550 nm) for 0.3 seconds to achieve exposure in an amount of E (erg/cm$^2$). The potential was measured at 0.7 seconds after the exposure (1 second after the charging) and the potential decay from $V_{PO}$ was calculated as dV/dE. The results are shown in Table 1.

COMPARATIVE EXAMPLES 1 AND 2

Compounds I-36 and II-19 were used individually as charge transporting materials in two separate comparative examples Four parts by weight of either compound and 6 parts by weight of a polycarbonate resin ("k-1300" of Teijin Chemicals Ltd.) were dissolved in 40 parts by weight of dichloromethane, and the resulting coating solution for a charge transporting layer was dipcoated on the charge generating layer that had been formed as in Example 1. The resulting photoreceptor was subjected to an evaluation test as in Example 1. The results are shown in Table 1.

COMPARATIVE EXAMPLE 3

An electrophotographic photoreceptor was prepared by the same manner as in Comparative Example 1 except that compound I-2 was used as a charge transporting material. The photoreceptor was evaluated by the same method as that employed in Example 1. The results are shown in Table 1.

EXAMPLES 2-4

Three additional samples of electrophotographic photoreceptors were prepared by the same manner as in Example 1 except that the combinations of compounds shown in Table 1 were used as charge transporting materials. The samples were evaluated by the same method as that employed in Example 1. The results are shown in Table 1.

TABLE 1

| | Charge transporting material | | dV/dE at $V_{PO}=-800V$ | After 2 cycles | | Fluctuations between 2 and 100 cycles | |
|---|---|---|---|---|---|---|---|
| | (I) | (II) | Vcm/erg | $V_{PO2}$ | $V_{R2}$ | $V_{PO}$ ($V_{PO100}-V_{PO2}$) | $V_{R}$ ($V_{R100}-V_{R2}$) |
| Example 1 | I-36 | II-19 | 230 | −790 | −20 | −10 | 0 |
| Comparative Example 1 | I-36 | — | 217 | −801 | −40 | −30 | +15 |
| Comparative Example 2 | — | II-19 | 210 | −790 | −45 | −25 | +20 |
| Comparative Example 3 | I-2 | — | 213 | −794 | −55 | −35 | +15 |
| Example 2 | I-29 | II-19 | 235 | −808 | −20 | 0 | 0 |
| Example 3 | I-29 | II-12 | 238 | −805 | −25 | −10 | 0 |
| Example 4 | I-2 | II-19 | 229 | −798 | −20 | −15 | 0 |

As is apparent from the results shown in Table 1, the samples of the present invention using compounds of (I) and (II) in combination were superior to the comparative samples using them individually with respect to photosensitivity (dV/dE), potential stability to cyclic operation ($\Delta V_{PO}$, $\Delta V_R$) and residual potential ($V_{R2}$).

As is clearly seen from the comparison between the Examples and the Comparative Examples, the photoreceptor of the present invention in which selenium or selenium alloy particles are used as a charge generating material in combination with a charge transporting material that comprises compounds of formulas (I) and (II) achieves better results than when the two compounds are used individually in terms of photosensitivity, potential stability to cyclic operation and residual potential. The photoreceptor of the present invention has the added advantage of high flexibility and ease of manufacture.

It will be apparent to those skilled in the art that various modifications and variations can be made in the electrophotographic photoreceptor of the present invention without departing from the scope or spirit of the invention. Thus, it is intended that the present invention cover the modifications and variations of this invention provided they come within the scope of the appended claims and their equivalents.

What is claimed is:

1. An electrophotographic photoreceptor comprising a light-sensitive layer on an electrically conductive substrate, wherein said light-sensitive layer comprises:

(1) particles of selenium or selenium alloy as the charge generating material; and (2) at least one compound represented by formula (I), (I)

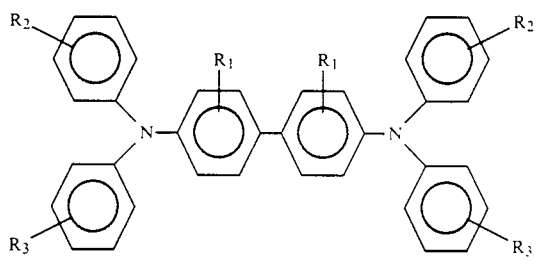

wherein $R_1$ represents a hydrogen atom, an alkyl group or an alkoxyl group; $R_2$ and $R_3$, which may be the same or different, represent each a hydrogen atom, a halogen atom, an alkyl group, an alkoxyl group, an alkoxycarbonyl group or a substituted amino group, and at least one compound represented by formula (II),

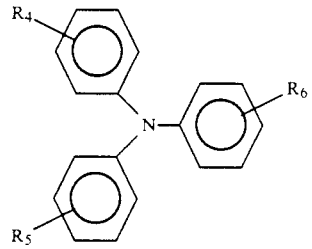

wherein $R_4$, $R_5$ and $R_6$, which may be the same or different, represent each a hydrogen atom, a halogen atom, an alkyl group, an alkoxy group, an alkoxycarbonyl group or a substituted amino group, as the charge transporting materials.

2. The electrophotographic photoreceptor as claimed in claim 1, wherein said light-sensitive layer comprises a charge generating layer formed on the electrically conductive substrate, and a charge transporting layer formed on the charge generating layer, said charge generating layer comprising said charge generating materials dispersed in a film-forming binder resin, and said charge transporting layer comprising said charge transporting materials dispersed in a film-forming binder resin.

3. The electrophotographic photoreceptor as claimed in claim 1, wherein said light-sensitive layer comprises a charge transporting layer formed on the electrically conductive substrate, and a charge generating layer formed on the charge transporting layer, said charge transporting layer comprising said charge transporting materials dispersed in a film-forming binder resin, said charge generating layer comprising said charge generating materials dispersed in a film-forming binder resin.

4. The electrophotographic photoreceptor as claimed in claim 2, wherein the content of said particles of selenium or a selenium alloy in said charge generating layer is in the range of from 30 to 80 vol %.

5. The electrophotographic photoreceptor as claimed in claim 1, wherein said particles of selenium or a selenium alloy are particles of undoped trigonal selenium.

6. The electrophotographic photoreceptor as claimed in claim 1, wherein said particles of said selenium or a selenium alloy have a particle size of 1 micron or smaller.

7. The electrophotographic photoreceptor as claimed in claim 2, wherein the thickness of said charge generating layer is from about 0.01 to about 5 microns.

8. The electrophotographic photoreceptor as claimed in claim 2, wherein said charge transporting material comprises the compound represented by formula (I) and the compound represented by formula (II) in about equal proportions, and the ratio of said charge transporting materials to said film-forming resin of said charge transporting layer is from 5/1 to 1/5.

9. The electrophotographic photoreceptor as claimed in claim 2, wherein the thickness of said charge transporting layer is from about 5 to 50 microns.

10. The electrophotographic photoreceptor as claimed in claim 1, wherein the alkyl groups in the compounds of formula (I) and formula (II) each have from 1 to 5 carbon atoms.

11. The electrophotographic photoreceptor as claimed in claim 1, wherein the alkoxyl groups in the compounds of formula (I) and formula (II) each have from 1 to 5 carbon atoms.

12. The electrophotographic photoreceptor as claimed in claim 1, wherein the alkoxycarbonyl groups in the compounds of formula (I) and formula (II) each have from 2 to 6 carbon atoms.

* * * * *